US005211493A

United States Patent [19]

Stephenson et al.

[11] Patent Number: 5,211,493

[45] Date of Patent: May 18, 1993

[54] COOLING SYSTEM FOR A THERMAL PRINTING HEAD

[75] Inventors: Stanley W. Stephenson, Spencerport; Frederick J. Oleson, Brockport; Peter J. Leas, Penfield, all of

[73] Assignee: Eastman Kodak Company, Rochester, N.Y.

[21] Appl. No.: 894,687

[22] Filed: Jun. 5, 1992

[51] Int. Cl.[5] ..... B41J 2/375

[52] U.S. Cl. ..... 400/719; 400/120; 346/76 PH; 361/382; 165/80.4; 165/80.5

[58] Field of Search ..... 400/120, 124, 124 TC, 400/719; 346/76 PH, 146; 361/382, 385; 165/80.4, 80.5

[56] References Cited

U.S. PATENT DOCUMENTS

| | | | |
|---|---|---|---|
| 4,160,896 | 7/1979 | Fujimori et al. | 219/216 |
| 4,438,692 | 3/1984 | Yanadori et al. | 101/93.04 |
| 4,496,824 | 1/1985 | Kawai et al. | 219/216 |
| 4,540,295 | 9/1985 | Okunishi et al. | 400/120 |
| 4,579,469 | 4/1986 | Falcetti | 400/124 |
| 4,664,542 | 5/1987 | Tsugita | 400/124 |
| 4,730,665 | 3/1988 | Cutchaw | 165/80.4 |
| 4,778,297 | 10/1988 | Watahiki et al. | 400/719 |
| 4,797,837 | 1/1989 | Brooks | 364/519 |
| 4,819,011 | 4/1989 | Yokota | 400/120 |
| 4,841,120 | 6/1989 | Yagino et al. | 219/216 |
| 4,897,762 | 1/1990 | Daikoku et al. | 361/382 |
| 4,968,160 | 11/1990 | Ishizuka | 400/124 |
| 5,017,941 | 5/1991 | Drake | 361/385 |
| 5,053,792 | 10/1991 | Une | 346/146 |

FOREIGN PATENT DOCUMENTS

| | | | |
|---|---|---|---|
| 22070 | 2/1982 | Japan | 400/719 |
| 175261 | 7/1990 | Japan . | |
| 206560 | 8/1990 | Japan . | |

*Primary Examiner*—Edgar S. Burr
*Assistant Examiner*—Stephen R. Fonk
*Attorney, Agent, or Firm*—Raymond L. Owens

[57] ABSTRACT

A cooling system is provided for a thermal print head that has a thermal dye transfer portion and a rear surface. The cooling system includes a bracket defining an open reservoir, and is attached to the print head so that the rear surface of the print head closes the reservoir. Cooling fluid is pumped into the reservoir and brought into contact with the rear surface to effect cooling of the print head. The bracket is removably attached using bolts with o-rings and a sealing gasket interposed between the bracket and print head.

6 Claims, 2 Drawing Sheets

COOLING SYSTEM FOR A THERMAL PRINTING HEAD

TECHNICAL FIELD OF THE INVENTION

The present invention relates generally to thermal printing, and, more particularly, to a cooling system for a thermal print head.

BACKGROUND OF THE INVENTION

In a typical thermal printer, a thermal printing head is used to supply the heat to cause the transfer of dye from a dye bearing donor web to a dye receiver medium. The heating elements are controlled to transfer a variable amount of dye to the receiver. It is desirable to print at the highest speed possible while maintaining control over dye deposition. The typical time required to print a single line has decreased from over thirty milliseconds to about five milliseconds. As the speed has increased, the effective power delivered to the head has steadily increased. The higher amounts of power delivered to the head can affect the temperature of the head which will vary the amount of dye deposited. Accordingly, it will be appreciated that it would be highly desirable to maintain the print head at a constant temperature for consistent printing results.

Several methods have been used to control the print head temperature. U.S. Pat. No. 4,496,824, which issued Jan. 29, 1985 to Kawai et el., discloses a system that uses the head itself to raise the head temperature, and a fan to prevent overheating. U.S. Pat. No. 4,797,837 which issued Jan. 10, 1989 to R. M. Brooks, discloses a thermoelectric heater/cooler to control the temperature of the thermal head. U.S. Pat. No. 4,968,160, which issued Nov. 6, 1990 to Y. Ishizuka, discloses a heat pump to control the temperature of a thermal head. The temperature controlling fluid is contained in a closed loop with a layer of material between the head and the fluid. Accordingly, it will be appreciated that it would be highly desirable to have a simple apparatus to cool the print head wherein the cooling fluid directly contacts the heat producing portion of the print head.

SUMMARY OF INVENTION

The present invention is directed to overcoming one or more of the problems set forth above. Briefly summarized, according to one aspect of the invention, a cooling system for a thermal print head that has a thermal dye transfer portion and a rear surface includes a bracket defining an open reservoir, and means for attaching the bracket to the print head so that the rear surface closes the reservoir. Cooling fluid is pumped into the reservoir and brought into contact with the rear surface to effect cooling of the print head.

The bracket is removably attached using bolts with o-rings, and a sealing gasket interposed between the bracket and print head. The print head is easily removed for repair or replacement with minimal loss of cooling fluid.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
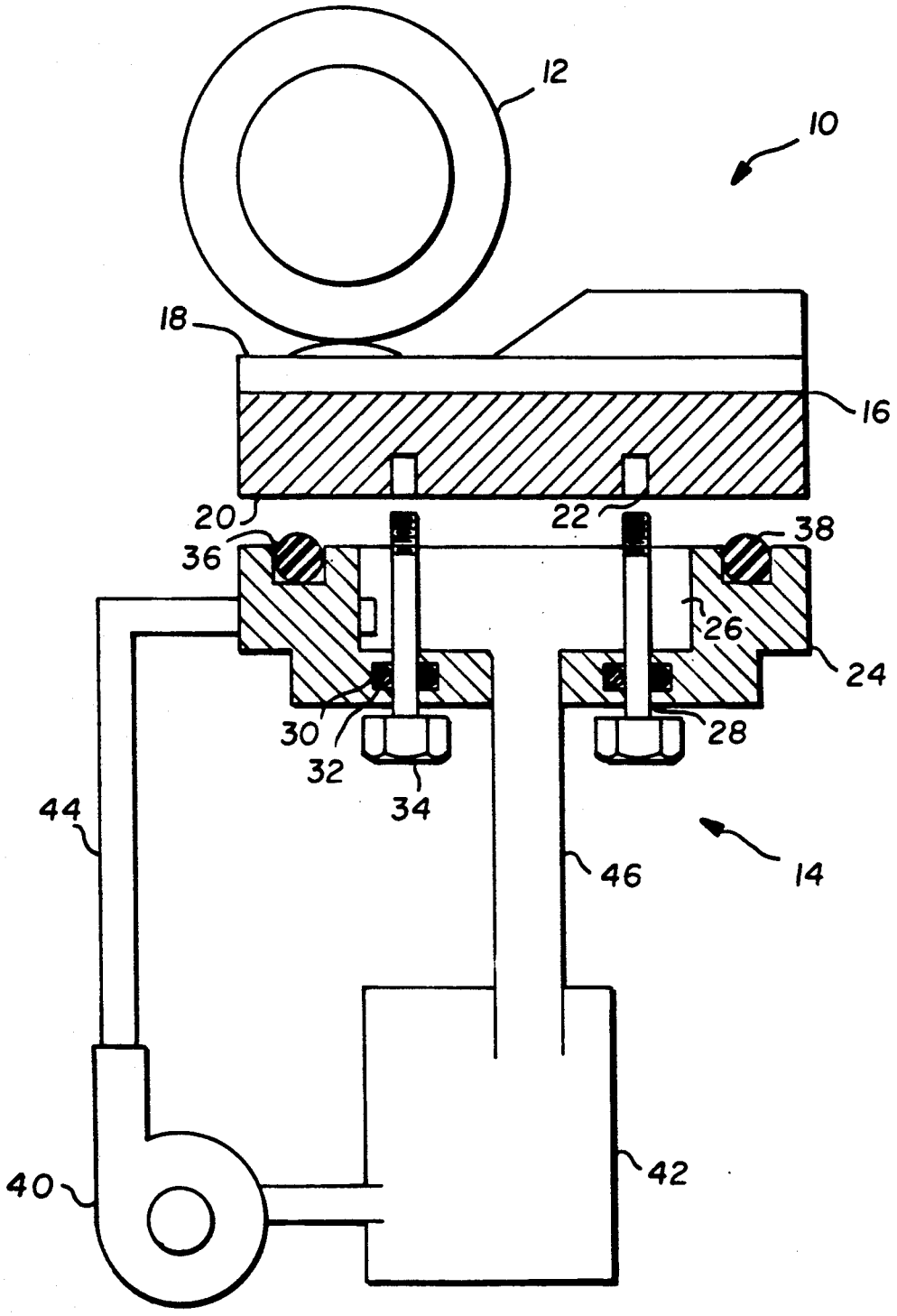
FIG. 1 is a diagrammatic view, partially in section, of a preferred embodiment of a print head with a cooling system.

Referring to FIG. 1, a thermal printer 10 includes a printing platen 12, and a cooling system 14 for maintaining the temperature of the thermal print head 16 within a preselected temperature range. As illustrated, the thermal print head 16 moves upward to make printing contact with the platen 12. The print head 16 has a thermal dye transfer portion 18 and a rear surface 20 with at least one, and preferably two or more, threaded openings 22 in the rear surface 20.

The cooling system 14 includes a bracket 24 with an opening defining a well or open reservoir 26 for receiving a cooling fluid. The bracket 24 has openings 28 equal in number to the number of threaded openings 22 in the rear surface 20. The openings 28 open into the reservoir 26. Each opening 28 has an annular opening 30 to receive an O-ring 32. The bracket openings 28, annular openings 30 and threaded openings 22 comprise a means for attaching the bracket 24 to the print head 16 so that the rear surface 20 of the print head 16 closes the reservoir 26. The attaching means includes a bolt 34 insertable through a bracket opening 28 and O-ring 32 to engage the threaded opening 22 to detachably attach the bracket 24 and print head 16.

The bracket 24 preferably has an annular recess 36 lying outside of the reservoir 26 that is fitted with a gasket, such as O-ring 38, to prevent the cooling fluid from leaking through the interface of the print head 16 and bracket 24.

The means for supplying cooling fluid to the reservoir 26 and bringing the cooling fluid into contact with the rear surface 20 of the print head 16 to effect cooling thereof includes a pump 40. The pump 40 delivers cooling fluid, preferably from a coolant reservoir 42, to the bracket reservoir 26 through inlet tube 44. The pump 40 delivers cooling fluid through the inlet tube 44 at a rate sufficient to cause the cooling fluid to contact the rear surface 20.

Spent cooling fluid is removed from the reservoir 26 through outlet tube 46. Because the outlet 46 is at the lowest elevation, the force of gravity is sufficient to cause the cooling fluid to exit the reservoir 26 through the outlet tube 46.

Figure 2:
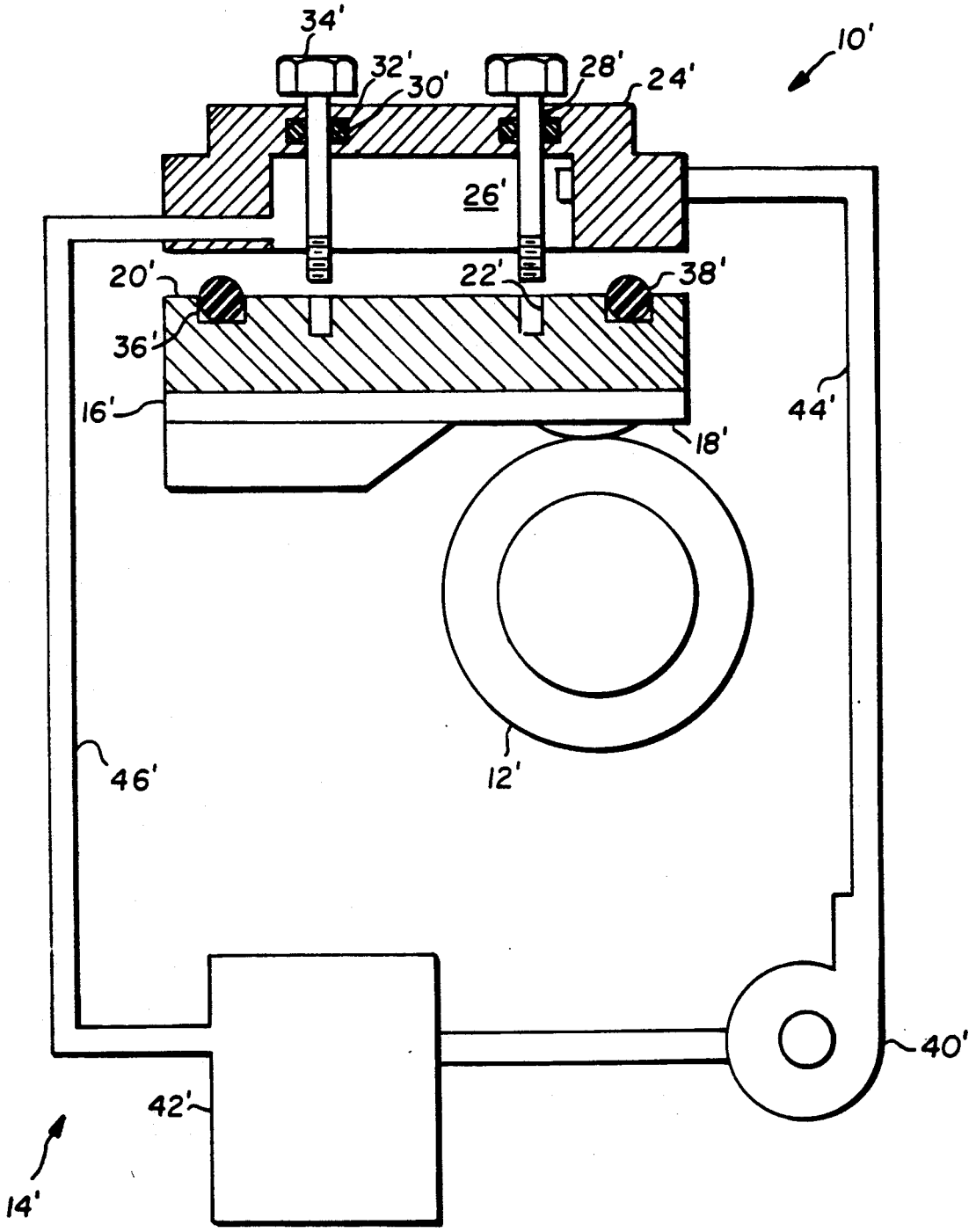
FIG. 2 is diagrammatic view similar to FIG. 1, but illustrating another preferred embodiment.

Referring to FIG. 2, another preferred embodiment is illustrated wherein the thermal print head 16' moves downward to make printing contact with the platen 12'. The pump 40' delivers cooling fluid through the inlet tube 44', and the force of gravity is sufficient to cause the cooling fluid to contact the rear surface 20' to effect cooling. Spent cooling fluid is removed from the reservoir 26' through outlet tube 46'. Because the outlet 46' is at the lowest elevation, the force of gravity is sufficient to cause the cooling fluid to exit the reservoir 26' through the outlet tube 46'. It may be preferable in some instances to have the O-ring 38' in the bracket 24' instead of the rear surface 20'. In that case, a small amount of cooling fluid may remain in the cavity 26' and not gravity drain.

Operation of the present invention is believed to be apparent from the foregoing description, but a few words will be added for emphasis. The gasket disposed between the print head and bracket prevents leaks. The print head and bracket are attached by bolts or screws that pass through O-rings in the bracket and screw into tapped holes formed in the rear surface of the print head. The coolant drain is positioned below the reservoir, so that the cavity is self-draining. A pump drives the fluid into the cooling cavity during normal operation. The restriction of the return line compared to the flow rate of the pump is sufficient to achieve this effect. When the pump is turned off, the fluid drains out of the reservoir.

Preferably, the print head is oriented with the printing side up. Replacement occurs by turning off the pump to drain the cavity. The fastening bolts are removed and the bracket and printing head are separated. The printing head and reservoir may be a little damp, but the loss of fluid will be minimal. Alternatively, the printing head is inverted so that the printing surface is facing downward. The reservoir drain is located close to the interface between the bracket and printing head to drain a maximum quantity of coolant during printing head replacement cycles.

While the invention has been described with particular reference to the preferred embodiments, it will be understood by those skilled in the art that various changes may be made and equivalents may be substituted for elements of the preferred embodiment without departing from the invention. For example, a blast of air can be directed through the reservoir after draining to remove more of the coolant, or additional electronically controlled valves and pumps can be used to effect more complete or faster draining. In addition, many modifications may be made to adapt a particular situation and material to a teaching of the invention without departing from the essential teachings of the present invention.

It can now be appreciated that there has been described a cooling system for a thermal print head that eliminates the thin layer of metal that typically separates the coolant from the rear surface of the print head. With the present invention, the cooling fluid flows directly against the rear surface of the print head. Because the rear surface of the print head transfers heat to the moving coolant fluid instead of the static metal, heat transfer is improved and the running temperature of the print head is reduced. The cooling fluid itself is used to establish intimate contact with the surface to be cooled.

It can also be appreciated that there has been described a cooling system for maintaining the print head at a constant temperature for consistent printing results. The cooling system is a simple apparatus that cools the print head by having the cooling fluid directly contact the heat producing portion of the print head.

As is evident from the foregoing description, certain aspects of the invention are not limited to the particular details of the examples illustrated, and it is therefore contemplated that other modifications and applications will occur to those skilled in the art. For example, self-siphoning and serpentine passages can be added to the coolant flow route to improve control over the fluid between the states of having a head mounted and not mounted. Various sensing means can be used to determine the presence or absence of the printing head, flow states and fluid levels at different points in the flow path to improve the management of the cooling fluids. It is accordingly intended that the claims shall cover all such modifications and applications as do not depart from the true spirit and scope of the invention.

What is claimed is:

1. A cooling system for a thermal printer, comprising:

a thermal print head having a rear surface with a threaded opening;

a bracket defining a reservoir with a reservoir opening, said bracket having an opening with an annular recess and forming an entrance to said reservoir;

an o-ring positioned in said annular recess;

a bolt insertable through said bracket opening and o-ring to engage said threaded opening to seal said entrance and to removably attach said bracket and print head so that said rear surface covers and closes said reservoir opening;

pump means for supplying cooling fluid to said reservoir and bringing said cooling fluid into contact with said rear surface of said print head to effect cooling thereof;

a gasket interposed between said bracket and said rear surface of said print head in sealing engagement to retain said cooling fluid; and a gravity fed outlet for draining cooling fluid from said reservoir so that said cooling fluid does not interfere with detaching said reservoir and print head to expose said reservoir.

2. A cooling system, as set forth in claim 1, wherein one of said bracket and said rear surface of said print head defines an annular opening and said gasket is an o-ring positioned in said annular opening.

3. A cooling system, as set forth in claim 1, wherein said bracket is at a lower elevation than said rear surface of said print head and said pump means delivers cooling fluid at a rate sufficient to completely fill said reservoir and contact said rear surface to effect cooling.

4. A cooling system, as set forth in claim 1, wherein said bracket is at a lower elevation than said rear surface of said print head and said pump means delivers cooling fluid at a rate sufficient to cause said cooling fluid to contact said rear surface of said print head to effect cooling.

5. A cooling system, as set forth in claim 1, wherein said bracket is at a lower elevation than said rear surface of said print head and said pump means for supplying cooling fluid to said reservoir includes an inlet positioned at a lower elevation than said rear surface of said print head.

6. A cooling system, as set forth in claim 1, wherein said bracket is at a higher elevation than said rear surface of said print head.

* * * * *